United States Patent [19]

Hutchinson

[11] Patent Number: 4,637,080

[45] Date of Patent: Jan. 20, 1987

[54] AIR VOLUME CONTROL

[76] Inventor: Charles H. Hutchinson, 5420 90th St., Lubbock, Tex. 79424

[21] Appl. No.: 816,318

[22] Filed: Dec. 19, 1985

[51] Int. Cl.[4] ..... A61H 33/02

[52] U.S. Cl. ..... 4/542; 4/492; 4/541; 4/544; 128/66; 137/216.2; 137/217; 137/430; 137/433

[58] Field of Search ..... 4/541, 542, 544, 543, 4/492; 128/66; 137/217, 216.2, 433, 430

[56] References Cited

U.S. PATENT DOCUMENTS

| | | | |
|---|---|---|---|
| 3,067,435 | 12/1962 | Nash | 4/492 |
| 3,221,800 | 12/1965 | Ballou | 137/433 X |
| 3,414,003 | 12/1968 | Wyckoff | 137/217 |
| 3,540,438 | 11/1970 | Jacuzzi | 128/66 |
| 3,874,374 | 4/1975 | Jacuzzi | 128/66 |
| 3,893,475 | 7/1975 | Hudson | 137/433 X |
| 4,013,091 | 3/1977 | Hudson | 137/433 X |
| 4,088,149 | 5/1978 | Logsdon | 137/433 |
| 4,168,705 | 9/1979 | Raab | 128/66 |
| 4,185,654 | 1/1980 | Young | 137/216.2 X |
| 4,296,778 | 10/1981 | Anderson | 137/433 |
| 4,577,353 | 3/1986 | Viegener | 4/544 |

*Primary Examiner*—Henry K. Artis

*Attorney, Agent, or Firm*—Walter F. Wessendorf, Jr.

[57] ABSTRACT

Disclosed is an air volume control for use with a flowing water line to control the quantity of air sucked by venturi action into the water line. The air volume control comprises a tubular valve body with a common member defining co-axial oppositely directed valve seats, one seat of which is automatically closed by a float valve in the event of reverse flow of water or back pressure of air into the valve body and the other seat of which is closed by a control valve when a regulator knob is rotated clockwise to the "off" position. In rotating the regulator knob counterclockwise to its "on" position, a cross pin follower of the regulator knob engaged with cam surfaces of the control valve unseats the control valve from its valve seat. Air is sucked into the water line through air entry ports in the valve body that are upstream of the control valve and float valve. Closing of either the control valve or float valve close off such air being sucked downstream past the valve seats into the flowing water line.

20 Claims, 9 Drawing Figures

FIG. 2
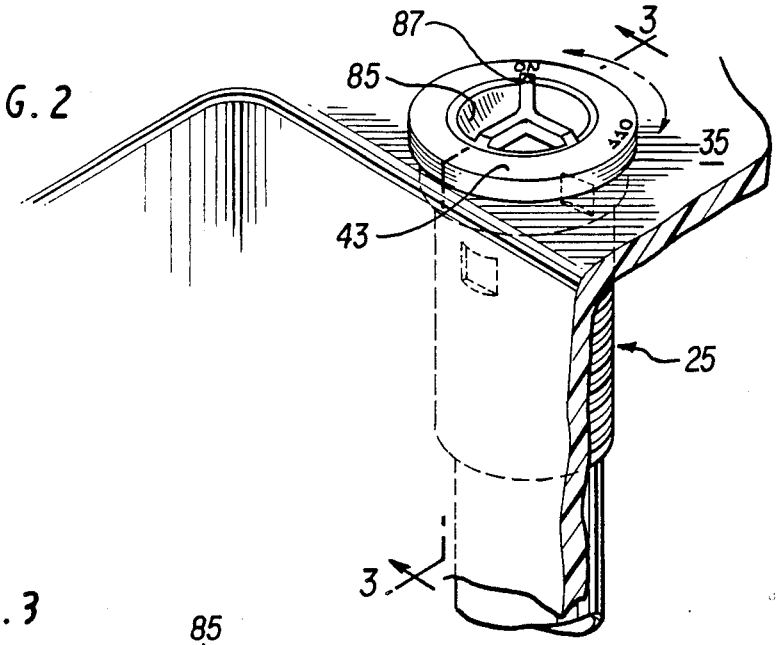
FIG. 3
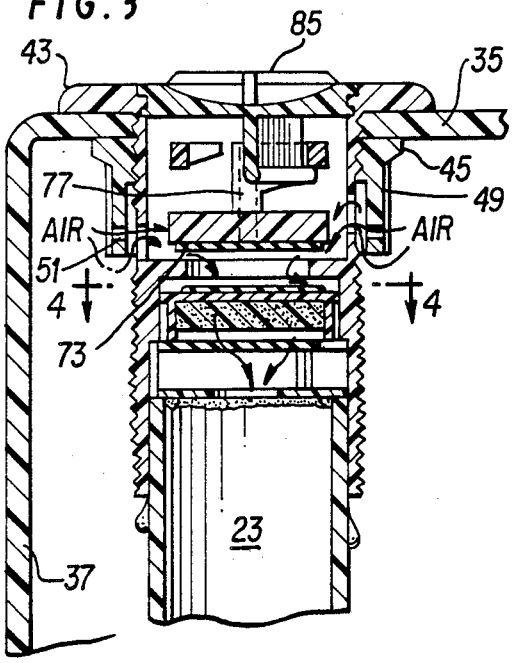
FIG. 5
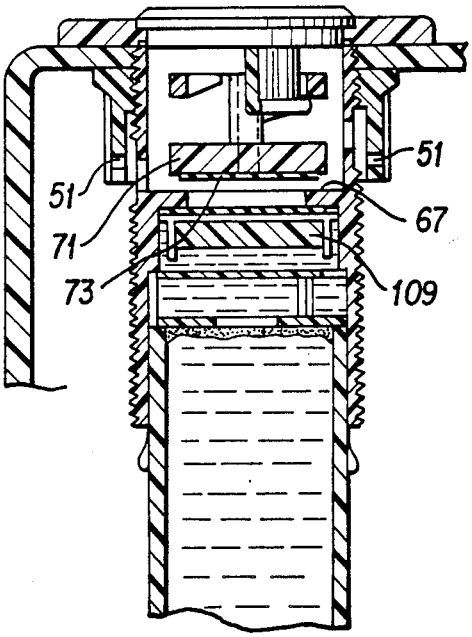
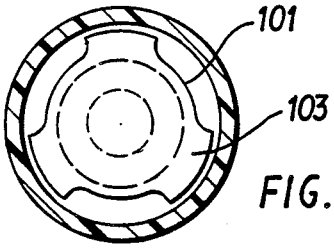
FIG. 4

AIR VOLUME CONTROL

BACKGROUND OF THE INVENTION

1. Technical Field

This invention relates to an air volume control for use with hot tubs, spas and jetted baths to regulate the quantity of atmospheric air to be drawn or sucked by venturi action into the streams of water discharged through the jets into the insides of the tub. The aerated water discharged through such jets provides vigorous massage for the body of the bather.

2. Background

Hot tubs, spas and jetted baths are filed with heated water. A submerged suction drain and a water-line skimmer allow the tub water to be drawn into the suction side of a pump and pumped under pressure for return via a return water line to jets mounted on the tub wall for discharge into the insides of the tub. By aerating such recirculated return water that is discharged through the jets, vigorous and surging massage is provided for the body of the bather. To mix air with such recirculating water, an air volume control is provided that is operatively connected to and in communication with such recirculating water.

Venturi action of such recirculating waters draws atmospheric air through the air volume control and mixes such air with the recirculating water. If a discharge jet is physically blocked during such water recirculation, water will reverse flow or air will back up into the air line through which the atmospheric air is being drawn into such recirculating water. If a hydrotherapy bath is installed on the second floor of a building, for example, damage can result to a ceiling immediately below from water leaking through the air volume control from reverse flow of water.

When heated water is being recirculated by the pump with the air volume control being closed and without the water being aerated, a leaking air volume control will cause atmospheric air to be drawn into the heated water and cool same at great expense because it is expensive to heat water.

Hence, the problem in the art to which this invention apertains is the need for a leakproof air volume control which has a tubular valve body with a common member defining co-axial oppositely directed valve seats. One valve seat is automatically closed by positive engagement of a float valve in the event of reverse flow of water or back up of air into the air line. The other valve seat is positively engaged by a control valve in its closed position by venturi action of such recirculating water imposing suction. The control valve is movable rectilinearly and co-axially relative to the longitudinal axis of the tubular valve body by rotary movement of a regulator knob to an open position to regulate the atmospheric air to be drawn through the air volume control for mixing with such recirculating water.

SUMMARY OF THE INVENTION

Accordingly, the object of the invention is to contribute to the solution of the discussed problem of the art by providing a leakproof air volume control for use either in its closed position with recirculating water under pressure flowing to the jets for discharge into the tub, or in its open position with air being drawn through the air volume control and mixing with such recirculating water under pressure flowing to the jets for discharge into the tub. The air volume control has a tubular valve body that has air entry ports; and a common member defining coaxial oppositely directed valve seats. One of the valve seats is automatically closed by positive engagement by a float valve in the event of reverse flow of water or back pressure of air into the tubular valve body. The other valve seat is constrained into its closed position by positive engagement of a control valve as a result of the venturi action of the recirculating water that sucks such control valve into its closed positive engagement with its valve seat. The control valve is movable rectilinearly and co-axially relative to the longitudinal axis of the tubular valve body being closed to open positions by rotary movement of such regulator knob. Appropriate rotary movement of such regulator knob opens the control valve against the constraining effect imposed by such venturi action of the recirculating water to close such control valve.

BRIEF DESCRIPTION OF THE DRAWINGS

This object and other objects of the invention should be discerned and appreciated by reference to the drawings, wherein like reference numerals are applied to similar parts throughout the several views, in which:

FIG. 2 is a view showing the air volume control mounted on the upper horizontal flange of a tub;

FIG. 3 is a sectional view taken along the line and in the direction of the arrows 3—3 in FIG. 2 and shows the air volume control in its "on" or open position;

FIG. 4 is a sectional view taken along the line and in the direction of the arrows 4—4 in FIG. 3;

FIG. 5 is a sectional view showing the float valve in seating engagement with its valve seat as a result of reverse flow of water into the valve body of the air volume control;

DESCRIPTION OF THE PREFERRED EMBODIMENT

Figure 1:
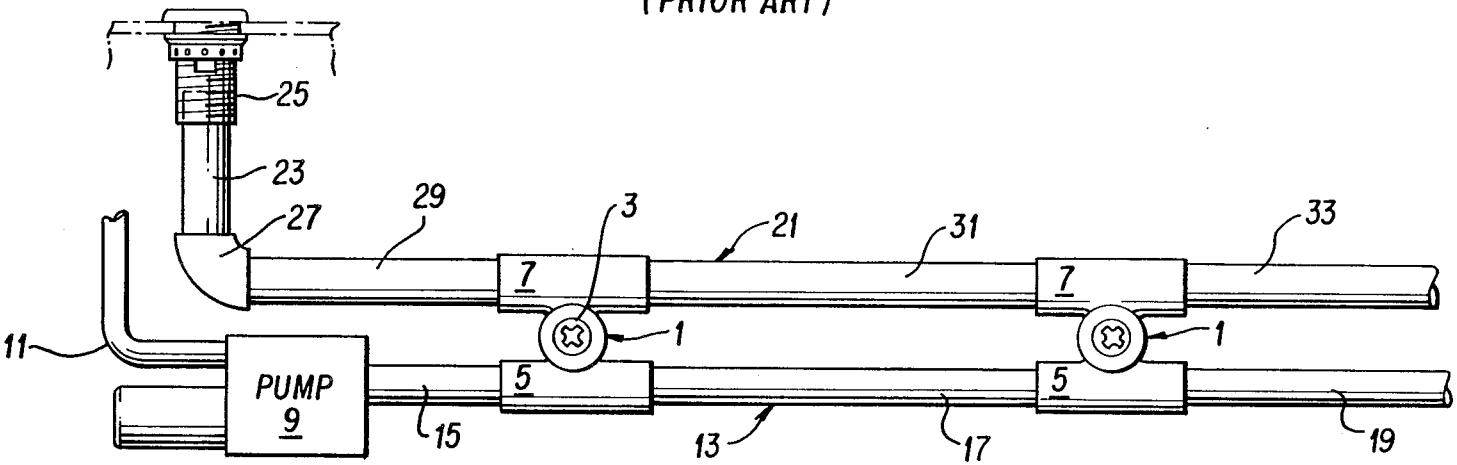
FIG. 1 (PRIOR ART)
FIG. 1 shows the air volume control of this invention employed with a prior-art installation.
Figure 9:
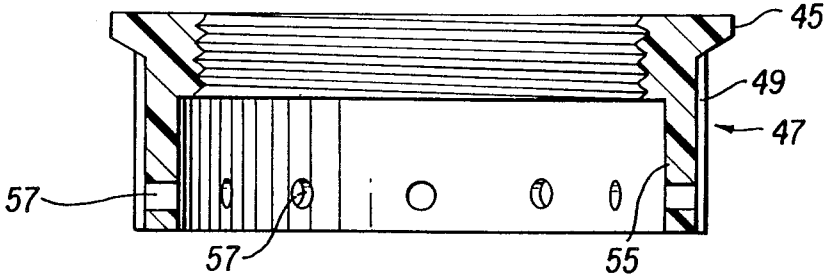
FIG. 9 is a sectional view of the jam nut.

FIG. 1 shows jet assemblies 1 which have their jets 3 mounted on the wall of a tub to discharge high-velocity streams of water mixed with air on the insides of the tub. The jet assemblies 1 have water and air couplings 5 and 7 interconnected with and in communication with the jets 3. A pump 9 has a suction side that draws water via a conduit 11 from a submerged suction drain in the tub and from a water-line skimmer and pumps such water under pressure through a water line 13 defined by conduit 15 connected to the first of the water couplings 5, the first and second water couplings interconnected by conduit 17, and conduit 19 connected to the second of the water couplings. The air line 21 is defined by a conduit 23 interconnecting the air volume control 25 of the invention and elbow 27, conduit 29 interconnecting elbow 27 and the first of the air couplings, conduit 31 interconnecting the first and second air coupings, and conduit 33 connected to the second of the air couplings. When the air volume control 25 is in its open position, venturi action of the water flowing through the water line 13 sucks air from the air volume control 25 through the air line 21 causing such air to be mixed with the water that will be discharged through the jets 3.

In FIG. 2, the air volume control 25 is shown in its "on" position. Air volume control 25 is shown mounted in fixed relationship on the upper horizontal flange 35 of a tub 37.

Air volume control 25 has a tubular valve body 39 that is externally threaded as indicated by reference numeral 41. Integrally formed on the end of valve body 39 is a top flange 43. Valve body 39 is disposed through a complemental opening in tub flange 35 with the lower portion of top flange 43 abutting the exterior surface of flange 43. The integral gasket portion 45 of jam nut 47 is disposed against the interior surface of tub flange 43 and jam nut 47 is appropriately hand-tightened on the threaded portion 41 of valve body 39. Jam nut 47 is hand-tightened because there usually is not enough room to position a wrench to tighten nut 47. Tne normal thickness of horizontal flange 35 is ⅜". Nut 47 has additional height along with external vertical ribs 49 to provide a hand-grasping surface area by which to grasp nut 47 for purposes of settling and initially tightening nut 47 on the threaded portion 41 of valve body 39. Thereafter, grips may be employed to complete the final tightening of jam nut 47.

Valve body 39 has air entry ports 51 with shouldered out portions 53 in valve body 39. About half the height ofjam nut 47 is shouldered out on the inside, as indicated by reference numeral 55, in order that atmospheric air can be drawn into the air entry ports 51 even if jam nut 47 covers such air entry ports 51 because the shouldered out portion 55 of jam nut 47 relative to the threaded portion 41 of valve body 39 defines an air path along with the shouldered out portions 53. Hence, atmospheric air flows vertically upwards through such defined air path and then horizontally through the air entry ports 51, as indicated by the air flow arrows in FIG. 3. Vent holes 57 in jam nut 47 allow flow of air horizontally through the air entry ports 51. Jam nut 47, as embodied with its shouldered out portion 55 and vent holes 57, help to prevent bugs and spiders from entering the air entry ports 51 with consequent plugging of the valve body 39 and malfunctioning of control valve 59 and float valve 61.

Integrally formed within the middle portion of valve body 39 is a common member 63 with a concentric air port 65. Common member 63 has co-axial oppositely directed valve seats 67 and 69.

Control valve 59 has a flat circular base member 71 to which is affixed on its bottom surface a concentric rubber seal 73. Vertically upstanding from the top surface 75 of base member 71 are radial bars 77 from which extend helical cam surfaces 79. Integral vertical projections 81 extend from radial bars 77. Opposed vertical slots 83, formed internally of valve body 39, complementally and freely receive and guide therein the vertical projections 81 of radial bars 77 to thereby constrain control valve 59 to rectilinear movement.

A regulator knob 85 has on its top surface a delta indicator 87. Integral with and depending from knob 85 is a spade element 89 which fixedly carries on its end a transverse cross pin follower 91. Regulator knob 85 has outturned ears 93 which operatively and freely engage an inwardly facing radial slot 95, formed in the upper end of valve body 39, to guide knob 85 for rotary movement and to removably retain knob 85 thereby.

As viewed in FIGS. 2, 3 and 5, regulator knob 85 is shown rotated counterclockwise to its open position with the delta indicator 87 pointing to the "on" indicia on the flange 43 of valve body 39. Such open position is achieved by cross pin follower 91 engaging the maximum parts of the cam surfaces 79 and engaging the left lateral sides 97 of the radial bars 77. In such open position and with water flowing through the water line 13, the venturi action of such flowing water will suck and draw atmospheric air through the radial air entry ports 51 into the interior of valve body 39 and thence through air port 65 of common member 63 and through the air line 21. Inasmuch as control valve 59 can not rotate, the left lateral sides 97 of the radial bars 77, engaged by cross pin follower 91 of regulator knob 85, function as limit stops to prevent further counterclockwise rotary movement of knob 85. It should be appreciated that, even with control valve 59 in its open position, such described venturi action of the flowing water will constrain control valve 59 downwardly with the maximum parts of the cam surface 79 pushing downwardly against the cross pin follower 91 but with control valve 59 maintained, nevertheless in its open position.

Figure 6:
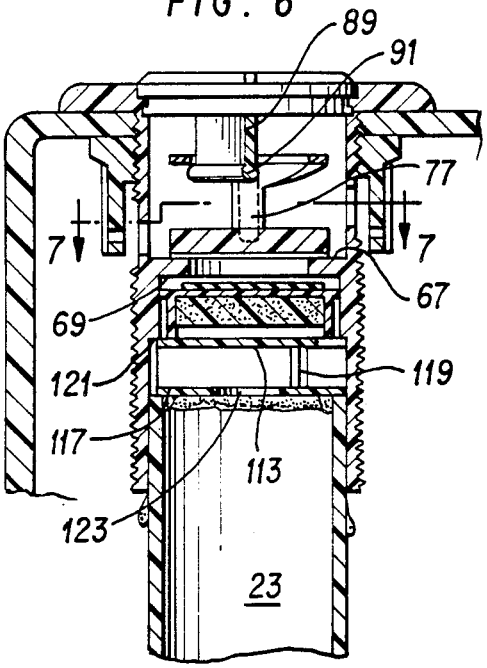
FIG. 6 is a sectional view showing the air volume control in its "off" or closed position.
Figure 7:
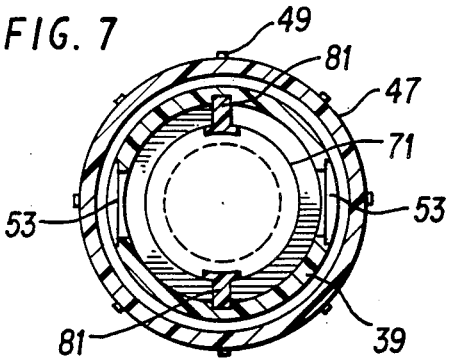
FIG. 7 is a sectional view taken along the line and in the direction of the arrows 7—7 in FIG. 6.
Figure 8:
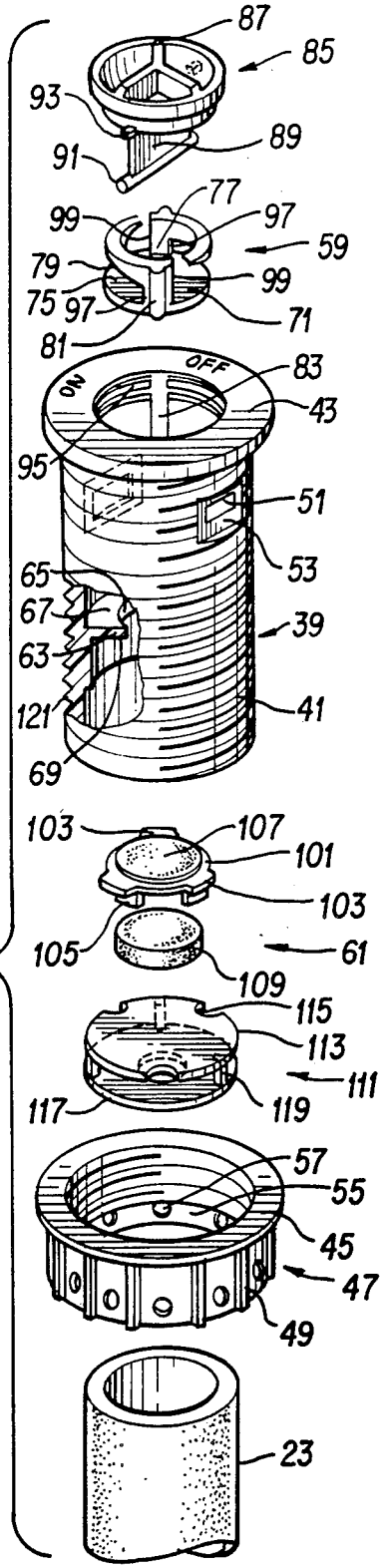
FIG. 8 is a view, partly in section, of the component parts of the air volume control preparatory to their assembly.

Regulator knob 85 is shown in FIG. 6 rotated clockwise to its closed position with delta indicator 87 pointing to the "off" indicia on flange 43; the rubber seal 73 fixed to control valve base member 71 will be in positive seating engagement with valve seat 67. Such closed position is achieved by cross pin follower 91 engaging the right lateral sides 99 of radial bars 77 and with follower 91 being free from any engagement with any part of the cam surfaces 79. In such closed position and with water flowing through the water line 13, such venturi action will create a vacuum beneath base member 71 of control valve 59 and maintain the rubber seal 73 in leakproof positive seating and sealing engagement with seat 67. The right lateral sides 99 of the radial bars 77, engaged by cross pin follower 91 of knob 85, function as limit stops to prevent further clockwise rotary movement of knob 85.

Float valve 61 has a flat circular base member 101 having radially projecting arms 103 and depending legs 105. Affixed to the top surface of base member 101 is a rubber seal 107. Fixedly mounted between depending legs 105 and the bottom surface of base member 101 is a cylindrical float element 109 of a closed-cell, airentrained, non-liquid absorbing material such as ETHAFOAM.

Fixedly carried within valve body 39 is a cage member 111. Cage member 111 has an upper flat circular element 113 formed with three radial slots 115. A washer element 117 is fixed to flat circular element 113 and spaced apart therefrom by three columns 119. Cage member 111 is inserted within valve body 39 sufficiently until flat circular element 113 abuts against shoulder 121 of valve body 39.

Valve seat 69 and flat circular element 113 of cage member 111 function as limit stops to restrict therebetween the up and down movements of float valve 61. In the normal operating condition of air volume control 25, the depending legs of float valve 61 will rest upon the top surface of flat circular element 113 of cage member 111 allowing the air path to the atmospheric air to continue upwardly through the air port 65 of common element 63, between the radially projecting arms 103 of float valve 61, downwardly through the radial slots 115 of circular element 113, through the hole 123 of washer element 117 and through the air line 21.

In the event of reverse flow of water or back pressure of air into the air volume control 25, the float valve 61 will move immediately upward with the rubber seal 107 of float valve base member 101 in leakproof positive seating and sealing engagement with valve seat 69. Float valve 61 will be maintained in such leakproof positive seating and sealing relationship with valve seat 69 until the reverse flow of water or back pressure of air ceases, at which time float valve 61 wil drop down with its depending legs 105 once again resting upon the top surface of flat circular element 113 of cage member 111 thereby allowing the air path flow of atmospheric air to resume.

It should be appreciated that upon such reverse flow of water, as shown in FIG. 5, the float element 113 will float upwardly carrying cage member 111 upwardly and effecting such leakproof positive seating and sealing relationship of rubber seal 107 with valve seat 69. For reason of the specified material utilized for the float element 109, float element 109 will not become waterlogged, heavy and malfunction by causing float valve 61 to drop down or break its seating engagement with valve seat 69 so long as the condition of reverse water flow continues.

PVC glue is applied by means of a dauber to the insides of the lower portion of valve body 39 and conduit 23 is inserted therein to the extent that the end of conduit 23 abuts against the bottom surface of washer element 117 of cage member 111. Cage member 111 functions as a limit stop to limit the extent of the insertion of conduit 23 against the bottom surface of washer element 117. Cage member 111 serves also to prevent PVC glue from being applied to float valve 61 and to prevent PVC glue from being wiped from insertion of conduit 23 into float valve 61, and thereby to prevent float valve 61 from being glued fast within valve body 39. In applying PVC glue to the insides of valve body 39, only a small amount of PVC glue can be forced by the glue dauber through the hole 123 of washer element 117 and into the space between circular element 113 and washer element 117. This similarly applies when PVC glue is wiped from insertion of the conduit 23 through the hole 123 of washer element 117.

In most installations, the air volume control 25 will be connected to the air line 21 via a conduit 23 glued within the lower insides portion of valve body 39. Valve body 39 being externally threaded at 41 also permits the valve body 39 to be connected to a tapped female fitting by being screwed therein for an alternate manner of connection where required.

The air volume control 25 is made of suitable plastic material.

The jet assemblies 1 may be of the type sold by Jacuzzi Bros., Inc., Little Rock, Ark., as its "HT/WHT HYDRO-THERAPY FITTING" and described more fully in its trade literature E-1222, or may be of similar construction thereto.

Having thusly described my invention, I claim:

1. An air volume control for use with a flowing water line to control the quantity of air sucked by venturi action into said flowing water line; said air volume control comprising control valve means, valve seat means, float valve means; said control valve means having an open position and a closed position, said control valve means in its said open position being free from engagement with said valve seat means to thereby allow air to be sucked into said flowing water line, said control valve means in its said closed position being in leakproof positive seating and sealing engagement with said valve seat means to prevent air from being sucked into said flowing water line, said float valve means being responsive to reverse flow of water or back pressure of air to automatically close said valve seat means by leakproof positive seating and sealing engagement of said float valve means with said valve seat means.

2. An air volume control in accordance with claim 1, wherein said valve seat means comprises a common member having co-axial oppositely directed valve seat, wherein one of said valve seats is closed by engagement therewith of said control valve means in its said closed position and the other of said valve seats is automatically closed by engagement therewith of said float valve means upon reverse flow of water or back pressure of air.

3. An air volume control in accordance with claim 1, wherein said air volume control has air entry ports to provide the air sucked into said flowing water line, wherein said air entry ports are upstream of said control valve means and float valve means, and wherein the closing of said valve seat means by either said control valve means or float valve means closed off air sucked downstream past said valve seat means into said flowing water line.

4. An air volume control in accordance with claim 1, wherein said air volume control further comprises rotary means, wherein said rotary means and control valve means have cooperating drive means to dispose said control valve means in its open position or in its closed position upon appropriate rotary movement of said rotary means.

5. An air volume control in accordance with claim 1, wherein said air volume control has a valve body, wherein said valve seat means comprises a common member integral with said valve body and having co-axial oppositely directed valve seats, wherein one of said valve seats is closed by engagement therewith of said control valve means and the other of said valve seats is closed by engagement therewith of said float valve means.

6. An air volume control in accordance with claim 4, wherein said rotary means comprises a regulator knob, wherein said regulator knob has a follower, wherein said control valve means has cam surfaces, wherein said cooperating drive means are said follower of said regulator knob in operative engagement with said cam surfaces of said control valve means.

7. An air volume control in accordance with claim 5, wherein said valve body carries cage member means, and wherein said valve seat engageable by said float valve means and said cage member means function as limit stops to restrict therebetween up and down movements of said float valve means.

8. An air volume control in accordance with claim 1, wherein said float valve means has a bouyant element.

9. An air volume control in accordance with claim 1, wherein said air volume control has a valve body, wherein said valve body carries cage member means, said cage member means having an upper element, spacer elements and a washer element, said spacer elements being interposed between said upper element and said washer element and thereby spacing said upper element and washer element apart, and wherein said cage member means prevents foreign matter, such as PVC glue, from being inserted interiorly of said valve body beyond said cage member means.

10. An air volume control in accordance with claim 1, wherein said air volume control has an externally threaded valve body and a nut, wherein said nut is engaged with said threaded valve body to mount said air volume control on support structure.

11. An air volume control in accordance with claim 10, wherein said nut has sufficient height to provide thereby a handgrasping surface area by which to grasp said nut for purposes of initially hand-tightening said nut on said threaded valve body.

12. An air-volume control in accordance with claim 10, wherein said nut has sufficient height along with external vertical ribs to provide thereby a hand-grasping surface area by which to grasp said nut for purposes of initially hand-tightening said nut on said threaded valve body.

13. An air volume control in accordance with claim 10, wherein said valve body has air entry ports for the air to be sucked into said flowing water line, wherein said nut has an inside shouldered out portion to provide an air path to said air entry ports when said nut covers said air entry ports and to prevent spiders and bugs from entering said air entry ports.

14. An air volume control in accordance with claim 10, wherein said valve body has air entry ports for the air to be sucked into said flowing water line, wherein said nut has vent holes to provide an air path to said air entry ports when said nut covers said air entry ports and to prevent spiders and bugs from entering said air entry ports.

15. An air volume control in accordance wth claim 10, wherein said valve body has air entry ports for the air to be sucked into said flowing water line, wherein said nut has an inside shouldered out portion and vent holes to provide air paths to said air entry ports when said nut covers said air entry ports, and to prevent spiders and bugs from entering said air entry ports.

16. An air volume control in accordance with claim 1, wherein said air volume control has a valve body, wherein said valve body has internal opposed vertical slots, wherein said control valve means has vertical projections, wherein said vertical slots complementally and freely receive and guide therein said vertical projections of said control valve means to constrain said control valve means to rectilinear movement.

17. An air volume control in accordance with claim 6, wherein said air volume control has a valve body, wherein said valve body has at its upper end an inwardly facing radial slot, wherein said regulator knob has outturned ears, and wherein said outturned ears freely engage said inwardly facing radial slot to guide said regulator knob for rotary movement and to removably retain said regulator knob thereby.

18. An air volume control in accordance with claim 6, wherein said control valve means has radial bars having left lateral sides and right lateral sides, wherein, upon engagement of said follower of said regulator knob with said left lateral sides of said radial bars, further movement of said regulator knob in a counterclockwise direction is prevented, and, wherein, upon engagement of said follower of said regulator knob with said right lateral sides of said radial bars, further movement of said regulator kno in a clockwise direction is prevented.

19. An air volume control in accordance with claim 9, wherein said valve body has a shoulder in its lower portion and wherein said upper element of said cage member abuts against said shoulder in the lower portion of said valve body.

20. An air volume control in accordance with claim 1, wherein sad air volume control has a tubular valve body, a regulator knob and a cage member, wherein said valve body has at its upper end an inwardly facing radial slot, wherein said valve body has inwardly facing opposed vertical slots, wherein said valve seat means comprises a common member integral with said valve body and having co-axial oppositely directed valve seats, wherein said valve body has air entry ports for the air to be sucked into said flowing water line, wherein said valve body has a shoulder in its lower portion, wherein said regulator knob has outturned ears and a cross pin follower, wherein said control valve means has cam surfaces, wherein said control valve means has vertical radial bars having left and right lateral sides, wherein said vertical radial bars have integral vertical projections extending from said radial bars, wherein said cage member has an upper element, spacer elements and a washer element, said spacer elements being interposed between said upper element and said washer element and thereby spacing apart said upper element from said washer element, wherein said outturned ears of said regulator knob freely engage said inwardly facing radial slot of said valve body to guide said regulator knob for rotary movement and to removably retain said regulator knob thereby, wherein said inwardly facing opposed vertical slots of said valve body complementally and freely receive and guide therein said vertical projections of said vertical radial bars of said control valve means to constrain said control valve means to movement rectilinearly and co-axially relative to the longitudinal axis of said tubular valve body, wherein one of said valve seats of said common member is closed by engagement therewith of said control valve means in its said closed position and the other of said valve seats of said common member is automatically closed by engagement therewith of said float valve means upon reverse flow of water or back pressure of air, wherein said air entry ports of said valve body are upstream of said control valve means and said float valve means, and wherein the closing of either of said valve seats by either said control valve means or float valve means, respectively, closes off air being sucked downstream past said valve seats into said flowing water line, wherein said cross pin follower of said regulator knob is in operative engagement with said cam surfaces of said control valve means such that rotation of said regulator knob in one direction disposes said control valve means in its said open position and rotation of said regulator knob in the opposite direction disposes said control valve means in its said closed position, wherein, upon engagement of said cross pin follower of said regulator knob with said left lateral sides of said vertical radial bars of said control valve means, further rotary movement of said regulator knob in a counterclockwise direction is prevented and, wherein, upon engagement of said cross pin follower of said regulator knob with said right lateral sides of said vertical radial bars of said control valve means, further rotary movement of said regulator knob in a clockwise direction is prevented, wherein said upper element of said cage member abuts against said shoulder in the lower portion of said valve body, and wherein said valve seat engageable by said float valve means and said upper element of said cage member function as limit stops to restrict therebetween up and down movements of said float valve means.

* * * * *